US007582254B2

(12) United States Patent
Kenning et al.

(10) Patent No.: US 7,582,254 B2
(45) Date of Patent: Sep. 1, 2009

(54) MUD GUN CAP

(75) Inventors: Jack Kenning, Sandusky, OH (US); John Korhel, Huron, OH (US)

(73) Assignee: J.K. Industries, Inc., Huron, OH (US)

( * ) Notice: Subject to any disclaimer, the term of this patent is extended or adjusted under 35 U.S.C. 154(b) by 111 days.

(21) Appl. No.: 11/799,647

(22) Filed: May 2, 2007

(65) Prior Publication Data

US 2007/0262499 A1 Nov. 15, 2007

Related U.S. Application Data

(60) Provisional application No. 60/797,086, filed on May 3, 2006.

(51) Int. Cl.
*C21C 5/46* (2006.01)

(52) U.S. Cl. ..... 266/273

(58) Field of Classification Search ..... 266/273
See application file for complete search history.

(56) References Cited

U.S. PATENT DOCUMENTS 3,563,523 A * 2/1971 Wendt, Jr. ..... 222/172
5,346,186 A 9/1994 Given

FOREIGN PATENT DOCUMENTS

JP 06145739 A * 5/1994

* cited by examiner

*Primary Examiner*—Scott Kastler
(74) *Attorney, Agent, or Firm*—Calfee, Halter & Griswold LLP

(57) ABSTRACT

A mud gun cap is provided. The mud gun cap includes a flame resistant outer face, a ring and a mounting device wherein the mud gun cap connects to a mud gun nozzle to protect the mud gun nozzle from deterioration because of contact with molten iron and slag. The mud gun cap also prevents, or at least reduces the amount of, mud falling out of the nozzle while the mud gun nozzle is rotated into operation position. In some embodiments, the mud gun cap has a selectively movable circular barrier that at least partially prevents the mixture of mud and iron/slag in the tap hole.

24 Claims, 6 Drawing Sheets

MUD GUN CAP

RELATED APPLICATIONS

This application claims all of the benefits of, and priority to, U.S. Provisional Application Ser. No. 60/797,086 filed on May 3, 2006. Application Ser. No. 60/797,086 is also titled Mud Gun Cap and is incorporated herein in its entirety.

This invention relates generally to blast furnace iron making operations and more particularly to a cap for the nozzle of a mud gun.

BACKGROUND

Raw materials, including iron ore, limestone, and coke are added to a blast furnace where they are heated. As the raw materials are heated, molten iron forms at the bottom of the blast furnace and a layer of slag forms on top of the molten iron. After a sufficient volume of molten iron builds up at the bottom of the blast furnace, the blast furnace is tapped to remove the molten iron. A tap drill is used to tap the blast furnace by drilling out the tap hole. As the tap drill is removed, molten iron flows through the tap hole into a trough where it is routed to a waiting rail car.

When all of the molten iron is drained out of the blast furnace, or after a desired amount of iron has been drained from the blast furnace, the tap hole is sealed. The tap hole is sealed with a mud gun. An anhydrous mixture, commonly referred to as "mud" or "clay" is loaded into the mud gun. The mud gun rotates from a non-operating or resting position to its operating position. In its operating position the mud gun is positioned so that the nozzle 110 (FIG. 1) of the mud gun (not shown) is aligned with the tap hole 130. Mud 170 is extruded through the nozzle 110 and forced into the tap hole 130. The mud 170 forces the residual molten iron 160 and slag 150 that is in the tap hole 130 back inside the furnace 140. Inevitably, however, not all of the iron 160 and slag 150 is pushed back into the furnace 140 i.e., some of the iron 160 or slag 150 remains in the tap hole 130 and mixes with the mud 170 forming a mud and ore residue 180. The mud gun nozzle 110 remains in place until the mud 170 dries or cures. After the mud 170 is cured, the mud gun is rotated back away from the blast furnace 140.

The mud and ore residue 180 in the tap hole 130 cause binding and wear on the tap drill (not shown) during the subsequent tapping of the blast furnace 140. In addition, the mud and ore residue 180 causes the drill to walk resulting in an irregular shaped, or oversized hole. This is undesirable because the size of the drilled hole controls the speed of the flow of molten iron 160 out of the blast furnace.

In addition, as the nozzle 110 nears the tap hole 130, the nozzle 110 comes into contact with the molten iron 130 and slag 150. Overtime, the tip of the nozzle 110 deteriorates and the mud gun nozzle 110 must be replaced. The deterioration is often referred to as rat toothing, because the lower portion of the nozzle tip which routinely comes into contact with the molten iron 160 is eroded faster than the upper potion of the nozzle tip which occasionally comes into contact with the molten iron. Replacement of the mud gun nozzle 110 is expensive and time consuming.

In operation, prior to rotating the mud gun into position to plug the tap hole 130, the operator ensures that the mud 170 is at the end of the nozzle 110. Mud 170 at the end of the nozzle 110 prevents molten iron 160 from entering and deteriorating the nozzle 110 when the mud gun is rotated into position. However, as the mud gun rotates into position, mud 170 occasionally falls out of the nozzle 110 and into the trough 120. The mud 170 contacts the molten iron 160 and slag 150 and creates black smoke. This smoke often results in the environmental protection agency (EPA) issuing a fine to the steel manufacturer.

SUMMARY

A mud gun cap is provided. The mud gun cap includes a flame resistant outer face, a ring and a mounting device. The mud gun cap connects to a mud gun nozzle and protects the mud gun nozzle from deterioration because of contact with molten iron and slag. The mud gun cap also prevents, or at least reduces the amount of, mud from falling out of the nozzle while the mud gun is rotated into operating position. In some embodiments, the mud gun cap also at least partially prevents the mixture of mud and iron/slag in the tap hole.

DETAILED DESCRIPTION

Figure 2:
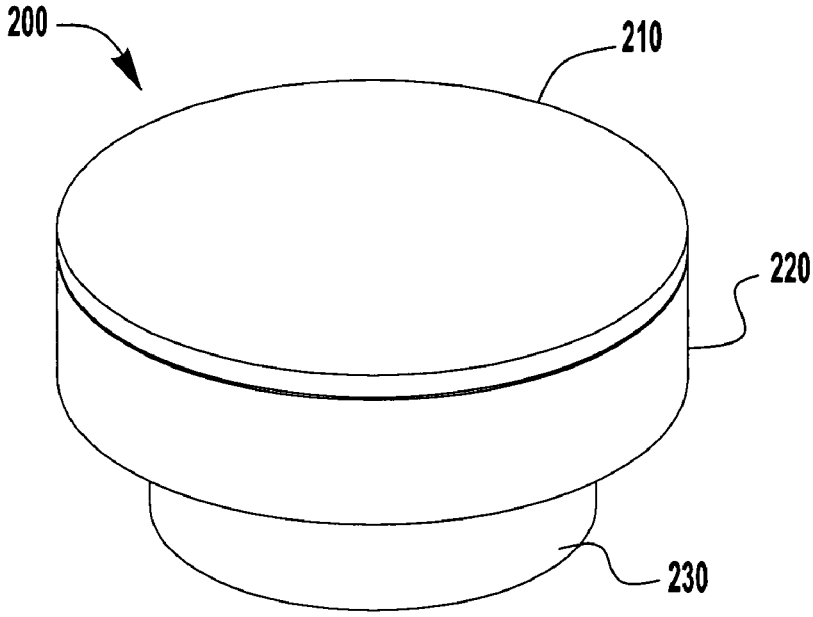
FIG. 2 is a side perspective view of an embodiment of a mud gun cap.
Figure 3:
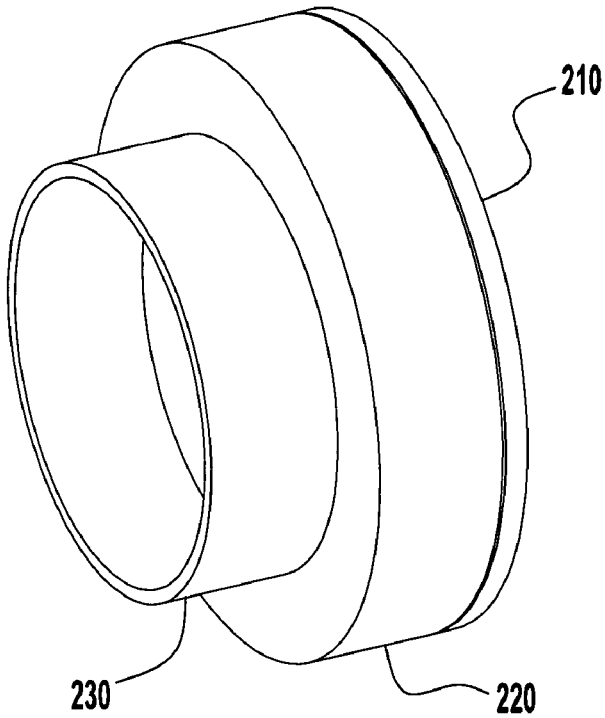
FIG. 3 is another perspective view of the mud gun cap of FIG. 2 tilted to rest on the side of its ring and outer face.
Figure 7:
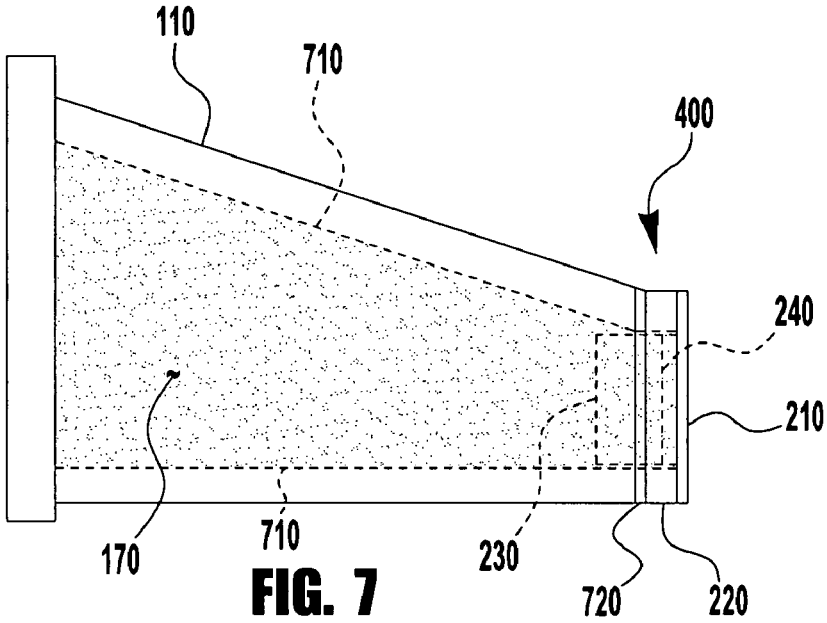
FIG. 7 is a side view of a mud gun nozzle having a mud gun cap connected thereto.

FIGS. 2 and 3 depict perspective views of an embodiment of a mud gun cap 200. The mud gun cap 200 includes an outer face 210, which is made of a flame resistant material, such as, for example a 2600 or 2800 degree Fahrenheit fiber. Outer face 210 is adhered to ring 220. Outer face 210 may be adhered to ring 220 using any means, such as, for example, glue or staples. The inside diameter 410 and outside diameter 420 of ring 220 (FIG. 4) is approximately the same size as the corresponding inside diameter 710 and outside diameter 720 of the mud gun nozzle 110 (FIG. 7). Ring 220 may be constructed of any material, such as ¾" particle board or plywood. Preferably, ring 220 is made of a flammable material that will ignite and burn after a certain period of time in contact with molten iron 160. A mounting device 230 is secured to ring 220. Mounting device 230 may be any type of device used to secure and position the mud gun cap 200 to a mud gun nozzle 110. In this embodiment, mounting device 230 is sheet metal formed in a cylindrical shape. The cylindrical sheet metal mounting device 230 has an outside diameter that corresponds roughly to the inside diameter of the mud gun nozzle 110 and the inside diameter of ring 220 as shown in FIG. 7. The cylindrical sheet metal mounting device 230 extends approximately an inch past the back surface 610

(FIG. 6) of the ring 220. The mounting device 230 is secured to ring 220 using any means, such as, for example, brads, screws, nails, glue, an adhesive, etc. Mounting device 230 fits snugly in the end of nozzle 110. Other mounting devices, such as, a device having two or more pins may be used.

Figure 4:
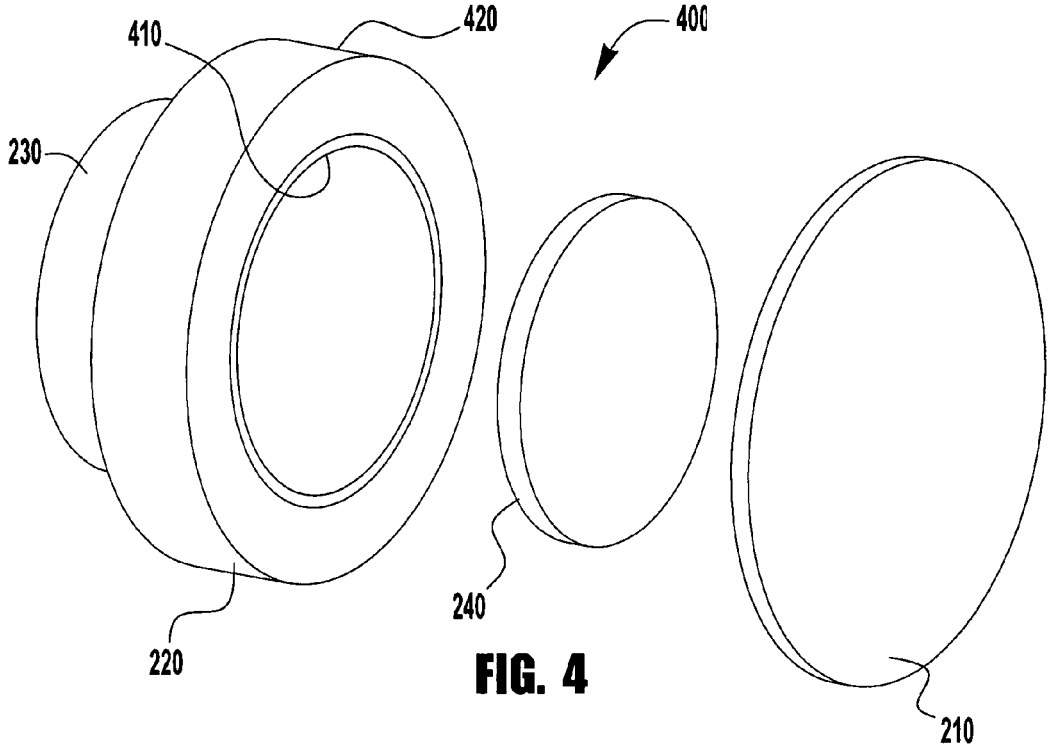
FIG. 4 is an exploded perspective view of an embodiment of a mud gun cap.
Figure 5:
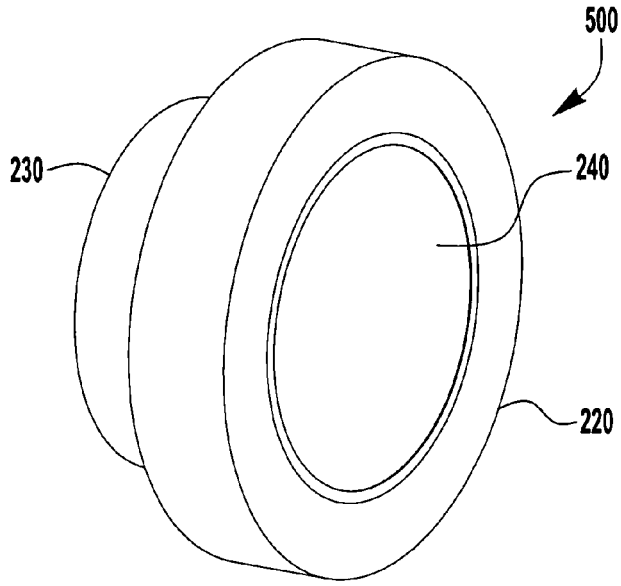
FIG. 5 is another perspective view of an embodiment of a mud gun cap with its parts in assembled form without an outer face.
Figure 6:
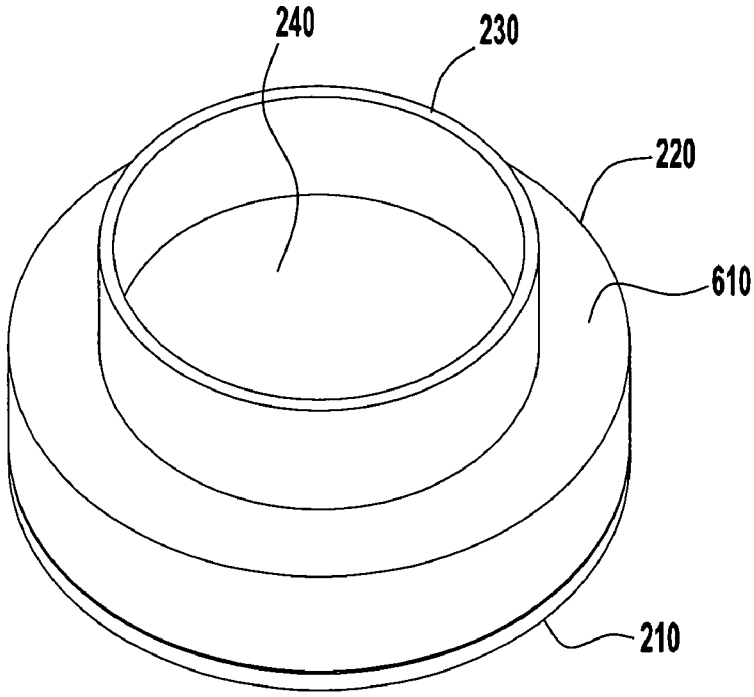
FIG. 6 is a rear perspective view of the mud gun cap in FIG. 4.

Another embodiment of a mud gun cap 400 is shown in FIG. 4. This view is an exploded view of the mud gun cap 400. This embodiment is similar to the embodiment described with respect to FIGS. 2 and 3, and numbers that correspond to previously described components are used here for similar components of this embodiment. In addition to the previously described components, mud gun cap 400 includes a circular barrier 240. Circular barrier 240 is made of a flame resistant material, such as, for example a 2600 or 2800 degree Fahrenheit fiber. Circular barrier 240 has an outside diameter that is approximately the same size as the inside diameter of the mounting device 230 and/or ring 220. As shown in FIGS. 5 and 6, circular barrier 240 is placed inside mounting device 230 up against outer face 210 (not shown in FIG. 5) and is held in place by friction. Optionally, circular barrier 240 may be held in place by other means, such as, for example, an adhesive.

FIG. 5 illustrates yet another embodiment of a mud gun cap 500. Mud gun cap 500 includes ring 210, mounting means 230 and circular barrier 240, but does not include outer face 210. While an outer face may be used, the front surface 500 of ring 220 may be covered instead by a layer of refractory material (not shown). Similar to the outer face, the layer of refractory material provides a flame resistant barrier, and may also be used to temporarily secure circular barrier 240 in place.

A mud gun nozzle 110 fitted with a mud gun cap 400 is shown in FIG. 7. The mud gun nozzle 110 has an interior surface 710. Mounting device 230 is fitted into the open end of the mud gun nozzle 110 and the mud gun cap 400 is pushed into place. The mounting device 230 fits snuggly against the interior surface 710. In addition, mud 170 inside of the mud gun nozzle 110 may also aid in securing the mud gun cap 400 in place through surface tension between the mud 170 and the mounting device 230. As previously described, mud gun cap 400 also includes outer surface 210, ring 220 and circular barrier 240. The mud gun cap 400 seals the end of the mud gun nozzle 110 and prevents mud 170 from falling out of the nozzle 110 and into the trough 120.

Figure 8:
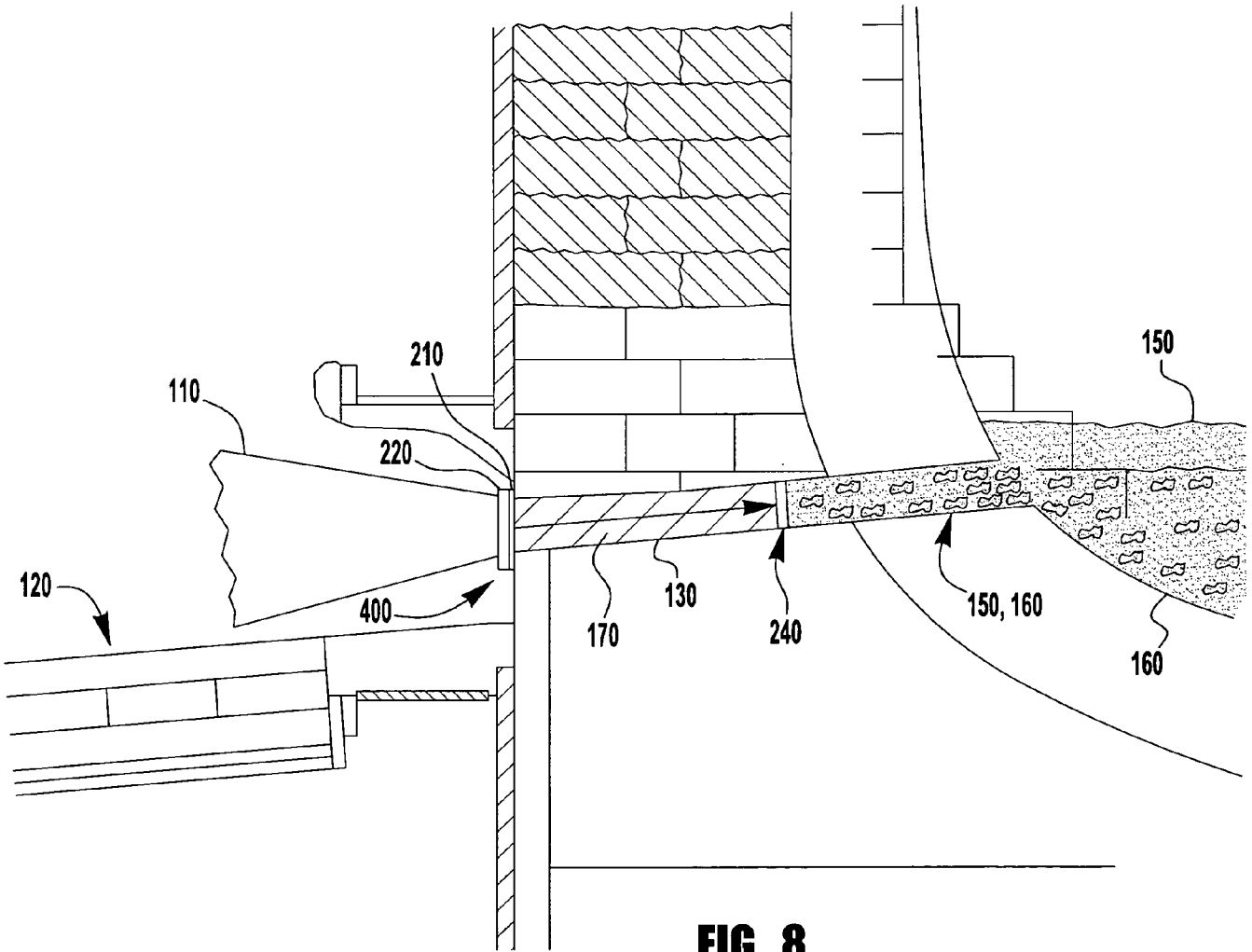
FIG. 8 is a cross sectional view of a blast a furnace, mud gun nozzle and a mud gun cap with mud injected into the tap hole and the circular barrier progressing through the tap hole.
Figure 9:
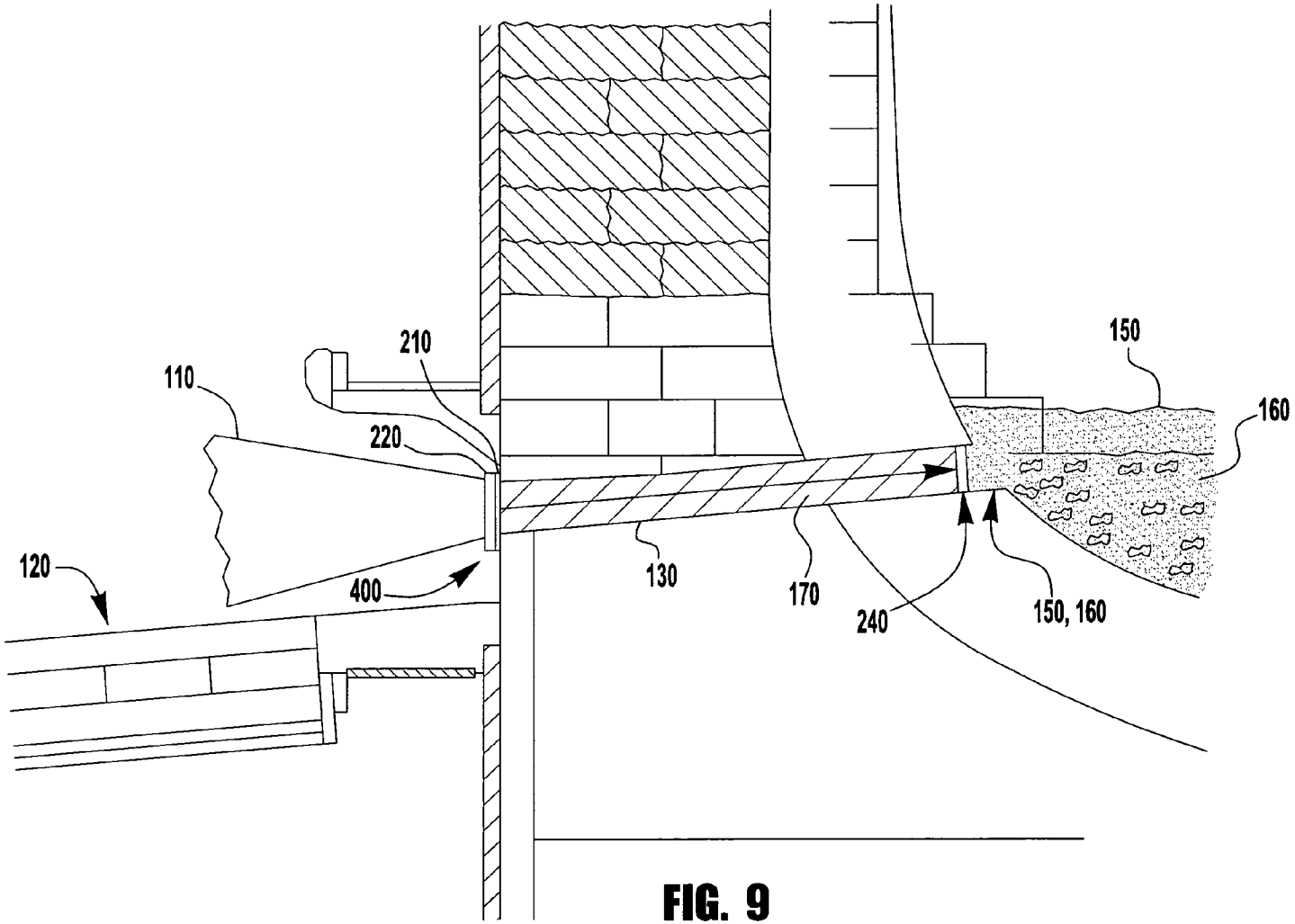
FIG. 9 is also a cross sectional view of a blast furnace, a mud gun nozzle and a mud gun cap with the mud fully injected and the circular barrier near the end of the tap hole.

FIGS. 8 and 9 illustrate operation of a mud gun (not shown) having a mud gun cap 400 on the mud gun nozzle 110. The mud gun is rotated into position to plug the tap hole 130 of the blast furnace 140. As the mud gun is rotated into position, the outer face 210 of mud gun cap 400 comes into contact with the molten iron 160 flowing out of the tap hole 130. The outer face 210, which may be 2800 degree Fahrenheit fiber, protects the mud gun cap 400 and the tip of the mud gun nozzle 110. As a result, use of the mud gun cap 400 extends the life of the mud gun nozzle 110 because the molten iron 160 does not come in contact with the mud gun nozzle 110 and cause deterioration.

When the mud gun is rotated into position, the outer face 210 is pressed firmly against the tap hole 130. The mud gun is activated and forces mud 170 through the nozzle 110. The pressure exerted by the mud 170 causes the outer face 210 to break or shear off allowing the mud 170 and circular barrier 240 to be forced up into the tap hole 130. Fractured portions of outer face 210 may fold over and remain secured to mud cap 400 or travel up the tap hole 130 along with the mud 170. Treatments, such as, for example, perforations, may be used to control the locations of the fractures so that the size and shape of the fractured portions of outer surface 210 are relatively predictable and whether or not the fragments of outer surface 210 remain attached to mud gun cap 400 or travel up the tap 130 along with the mud 170 is also predictable.

Figure 1:
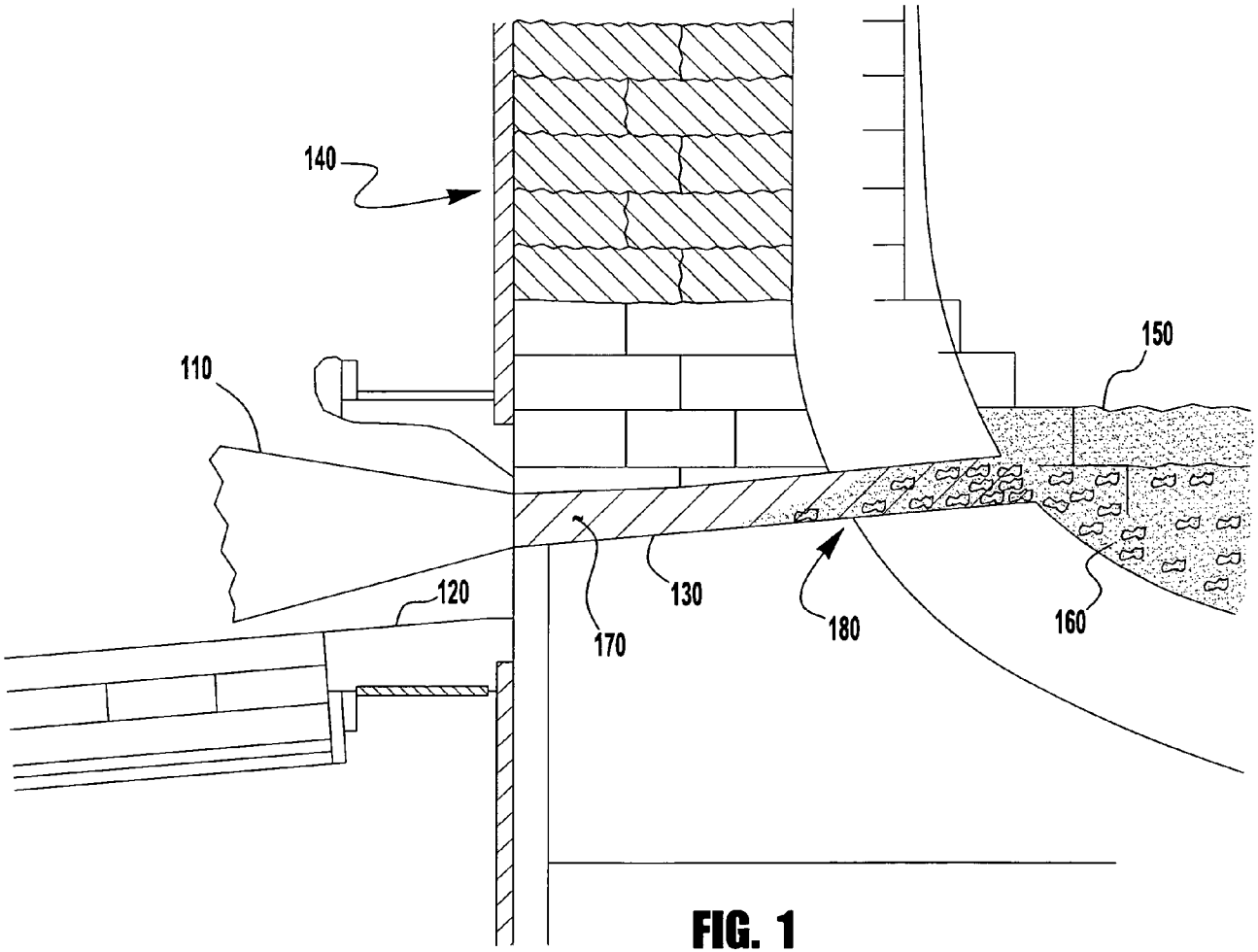
FIG. 1 PRIOR ART
FIG. 1 (Prior Art) is a cross-section of a blast furnace, a tap hole, a mud gun nozzle and a trough.

As the circular barrier 240 is forced up through the tap hole 130 it acts as a barrier between the slag/molten iron 150/160 and the mud 170. In FIG. 8 the circular barrier is shown about half way up the tap hole 130. In FIG. 9 the tap hole 130 is filled with mud 170 and the circular barrier 240 is shown near the end of the tap hole 130. The circular barrier 240 at least partially prevents slag/molten iron 150/160 from remaining in the tap hole 130 and mixing with the mud 170 to form a mud and ore residue 180 (illustrated in FIG. 1). After the mud 170 dries or cures, the mud gun is rotated back into its resting position. The mud gun cap 400 either falls off on its own, or is knocked off by an operator.

The material making up the mud gun cap 400 is combustible and/or will melt if it falls off into the trench 120 and comes into prolonged contact with the molten iron 160. In addition, since the tap hole 130 is now filled with mud 170 and contains less mud and ore residue 180, the tap hole drill (not shown) has an easier time drilling a clean hole in the tap hole 130 during subsequent tapping operations. This extends the life of the tap drill bit and allows for more precise control over the molten iron 160 flow rate.

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. For example the outer face 210 may be perforated around the inside edge of the ring 220 allowing a cleaner tear as the mud 170 is forced through. Therefore, the invention, in its broader aspects, is not limited to the specific details, the representative apparatus, and illustrative examples shown and described. Accordingly, departures may be made from such details without departing from the spirit or scope of the applicant's general inventive concept.

We claim:

1. A mud gun cap comprising a breakaway flame resistant outer face on a first end of a ring, the outer face being configured to breakaway when mud is expelled under pressure through the mud gun, and a mounting device secured to the ring and extending outwardly from a second end of the ring, wherein the mounting device connects the mud gun cap to a mud gun nozzle and the mud gun cap protects the mud gun nozzle and prevents mud from falling out of the mud gun nozzle while the mud gun nozzle is rotated into operation position to plug the tap hole of a blast furnace.

2. The mud gun cap of claim 1 further comprising a circular barrier inside of the mounting device, the circular barrier being detachably secured to, and configured to pass out of, the mud gun cap.

3. The mud gun cap of claim 1 wherein the flame resistant outer face is at least a 2600 degree Fahrenheit fiber.

4. The mud gun cap of claim 1 wherein the flame resistant outer face contains one or more perforations about the inside diameter of the ring.

5. The mud gun cap of claim 2 wherein the outer face has predetermined fracture lines, and the outer face fractures when mud is forced under pressure through the mud gun cap and the circular barrier passes into the tap hole to separate the mud from molten iron in the blast furnace.

6. A method of preventing mud from falling out of a mud gun nozzle during movement comprising: providing a mud gun cap having a breakaway flame resistant outer face; a ring; and a mounting device; installing the mud gun cap on a mud gun nozzle; moving the mud gun nozzle into an operating position; and forcing mud through the breakaway flame resistant outer face of the mud gun cap.

7. The method of claim 6 further comprising providing a circular barrier inside of the mud gun cap, the circular barrier being detachably secured to, and configured to pass out of, the mud gun cap.

8. The method of claim 6 further comprising forcing the circular barrier out of the mud gun cap and into a tap hole.

9. The method of claim 8 wherein the circular barrier forms a barrier between the mud and residual molten iron in the tap hole.

10. A mud gun cap comprising a breakaway outer face and a mounting device wherein the breakaway outer face prevents mud from falling out of a mud gun nozzle while a mud gun is rotated into position and the mounting device is configured to secure to the inside of the mud gun nozzle, and wherein the breakaway outer face is configured to break away as mud is force under pressure through the mud gun nozzle.

11. The mud gun cap of claim 10 wherein the outer face is a flame resistant fiber material.

12. The mud gum cap of claim 10 wherein the outer face is a refractory material.

13. The mud gun cap of claim 10 further comprising a circular barrier being detachably secured to, and configured to pass out of, the mud gun cap.

14. The mud gun cap of claim 13 wherein the circular barrier is a flame resistant fiber material.

15. The mud gun cap of claim 10 wherein the mounting device is sheet metal formed in a cylindrical shape.

16. A mud gun cap comprising a mounting device secured to a ring; a circular barrier inside of the ring, the circular barrier detachably secured to, and configured to pass out of, the mud gun cap and a layer of refractory material at least partially covering the outside face of the ring.

17. The mud gun cap of claim 16 wherein the mounting device comprises sheet metal.

18. The mud gun cap of claim 17 wherein the sheet metal is formed in a cylindrical shape.

19. The mud gun cap of claim 16 wherein the refractory material at least partially covers the circular barrier.

20. The mud gun cap of claim 16 wherein the refractory material at least partially covers the outside diameter of the ring.

21. The mud gun cap of claim 1 wherein the mounting device comprises two or more pins.

22. The mud gun cap of claim 10 wherein the mounting device comprises two or more pins.

23. The mud gun cap of claim 16 wherein the mounting device comprises two or more pins.

24. The method of claim 6 wherein the mounting device comprises two or more pins and installing the mud gun cap on the mud gun nozzle includes inserting at least a portion of the two or more pins into the mud in the end of the mud gun nozzle.

* * * * *